US006686840B1

(12) United States Patent
Hammond et al.

(10) Patent No.: US 6,686,840 B1
(45) Date of Patent: Feb. 3, 2004

(54) PERSONAL SECURITY ALARM SYSTEM

(76) Inventors: Dorothy L. Hammond, P.O. Box 21295, Wichita, KS (US) 67208; Blair Sutton, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/196,016

(22) Filed: Jul. 16, 2002

(51) Int. Cl.[7] ..... G08B 13/14

(52) U.S. Cl. ..... 340/568.7; 340/539.32; 340/571; 340/573.1

(58) Field of Search ..... 340/571, 574, 340/568.7, 539.22, 539.31, 539.32, 542, 691.5, 573.1

(56) References Cited

U.S. PATENT DOCUMENTS

| | | | | |
|---|---|---|---|---|
| 4,189,721 A | | 2/1980 | Doell | |
| 4,804,943 A | * | 2/1989 | Soleimani | 340/571 X |
| 4,843,371 A | | 6/1989 | Kuei et al. | |
| 5,001,460 A | | 3/1991 | Basson | |
| 5,043,702 A | | 8/1991 | Kuo | |
| 5,157,383 A | | 10/1992 | Fisher | |
| 5,337,041 A | | 8/1994 | Friedman | |
| 5,420,570 A | | 5/1995 | Leitten et al. | |
| 5,652,569 A | * | 7/1997 | Gerstenberger et al. | 340/573.1 |
| 5,955,948 A | | 9/1999 | Howell | |
| 5,963,131 A | * | 10/1999 | D'Angelo et al. | 340/568.1 |
| 6,121,877 A | | 9/2000 | Johnson et al. | |
| 2002/0097152 A1 | * | 7/2002 | Mengrone et al. | 340/571 |

* cited by examiner

*Primary Examiner*—Thomas J Mullen
(74) *Attorney, Agent, or Firm*—Dale J. Ream

(57) ABSTRACT

A personal security alarm system includes transmission and alarm housings. The transmission housing includes a transmitter connected to control buttons for selectively sending alarm or range signals. The alarm housing includes a receiver, CPU, alarm, and a mode switch. In automatic mode, the receiver receives continuous range signals from the transmitter and the CPU energizes the alarm if the range signals are not received. In alarm mode, the CPU energizes the alarm if the receiver receives a predetermined alarm signal. The alarm housing may be coupled to a quick-connect attachment of a purse. The purse includes an electro-mechanical locking assembly that may be energized by the CPU. The purse may be locked upon a sensed theft attempt or by a user pressing a control button on the alarm housing.

20 Claims, 9 Drawing Sheets

PERSONAL SECURITY ALARM SYSTEM

BACKGROUND OF THE INVENTION

The present invention relates generally to personal security devices and, more particularly, to a personal security alarm system to deter and prevent purse snatching.

Purse snatching is an age old criminal activity which can occur in many different ways and in many different situations. However, a similarity found in purse snatching is that the thief attempts to surprise the victim, grab the purse, and escape while the victim remains startled. The speed with which a purse snatching occurs makes personal defense products, such as pepper spray or an electrical stun gun, of little effect.

Therefore, it is desirable to have a personal security alarm system that enables a user to sound an alarm either automatically or at the user's direction. Further, it is desirable to have a personal security alarm system in which an alarm may be activated at the purse to which it is attached or from a remote location. In addition, it would be desirable to have an alarm system coupled to a purse that can automatically lock the purse immediately upon theft of the purse or at the user's direction. It would also be desirable if the alarm activation transmitter could be worn by the user as jewelry.

SUMMARY OF THE INVENTION

A personal security alarm system according to the present invention includes a transmission housing and an alarm housing. The transmission housing may include a chain or strap such that it may be worn by a user as a necklace. The transmission housing includes a transmitter and first and second control buttons electrically connected to the transmitter. A first control button causes the transmitter to constantly send range signals into the ambient air. The second control button causes the transmitter to send an alarm signal that is different than the range signals. The alarm housing includes a central processing unit ("CPU"), a receiver, an alarm, and a mode switch. The configuration of the mode switch causes the CPU to initiate a corresponding set of program instructions. When set at an automatic mode, the CPU energizes the alarm if expected range signals are not received by the receiver. This indicates that the alarm housing has been moved a predetermined distance away from the transmission housing, i.e. during a purse snatching. In the alarm mode, the CPU immediately energizes the alarm if the receiver receives an alarm signal from the transmitter.

The alarm housing may be releasably coupled to a purse having a quick-connect assembly. The purse includes an electromechanical locking mechanism for locking the purse in a closed configuration. When the alarm housing is attached to the purse, the CPU may energize the electromechanical locking mechanism to lock the purse in response to a sensed theft event or at the direction of the user.

Therefore, a general object of this invention is to provide a personal security alarm system which activates an alarm when a purse has been stolen.

Another object of this invention is to provide an alarm system, as aforesaid, which may be configured to activate the alarm when the purse and transmitter are more than a predetermined distance from one another.

Still another object of this invention is to provide an alarm system, as aforesaid, which may be configured to activate the alarm immediately either remotely or at the alarm housing by a user.

Yet another object of this invention is to provide an alarm system, as aforesaid, which includes a purse to which the alarm housing may be coupled.

A further object of this invention is to provide an alarm system, as aforesaid, in which the purse includes an electromagnetic locking mechanism that may be activated by a CPU within the alarm housing in response to sensing a theft event or at the user's direction.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
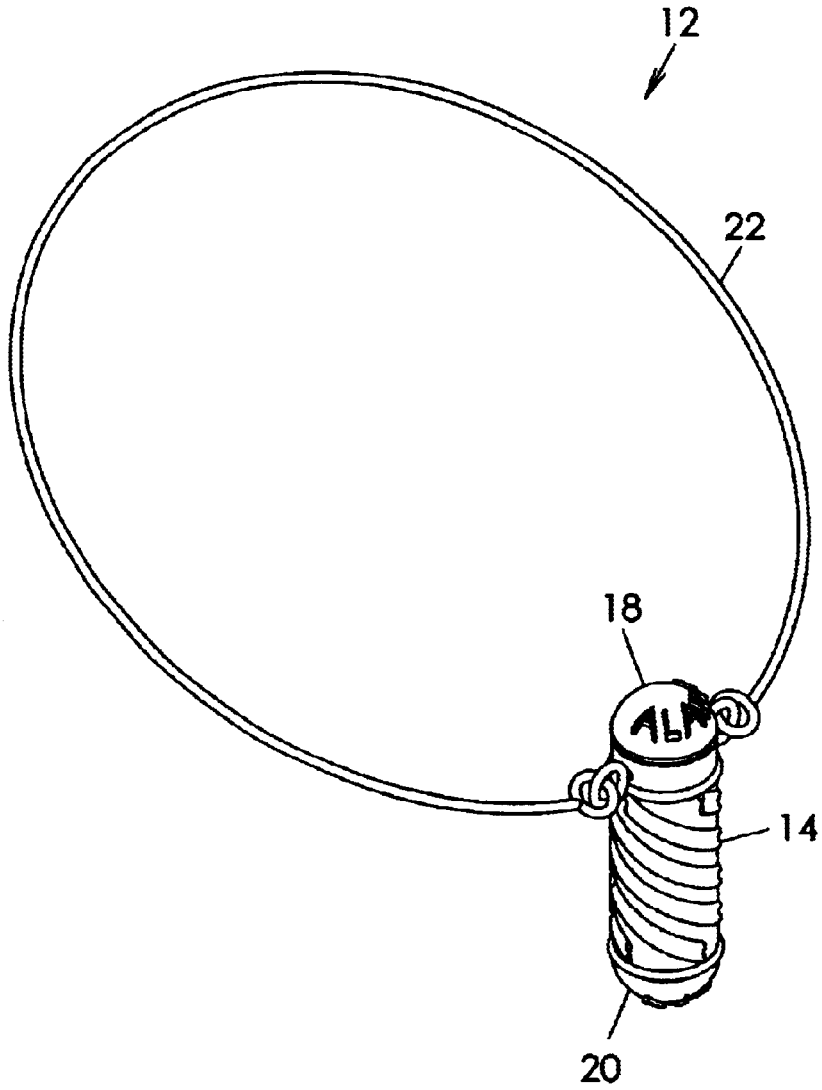
FIG. 1 is a perspective view of a transmission unit of a personal security alarm system according to a preferred embodiment of the present invention.
Figure 2:
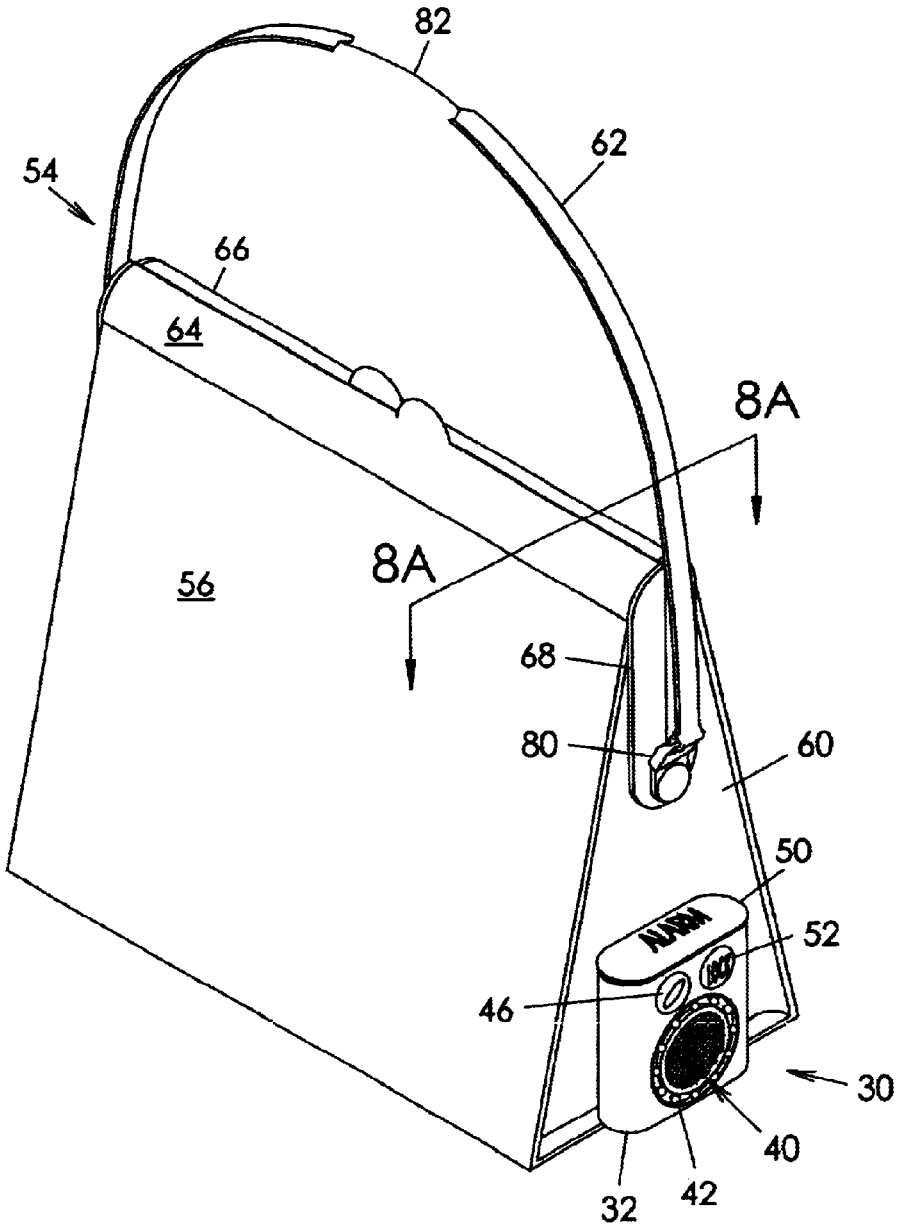
FIG. 2 is a perspective view of a purse and alarm unit of the personal security alarm system according to the present invention and with the purse in a closed configuration.

A personal security alarm system according to the present invention will now be described in detail with reference to FIGS. 1 through 8B of the accompanying drawings. The personal security alarm system includes a transmission unit 12 (FIG. 1) and an alarm unit 30 (FIG. 2). The alarm unit 30 may be releasably coupled to a specially designed purse 54, as to be described later.

Figure 3A:
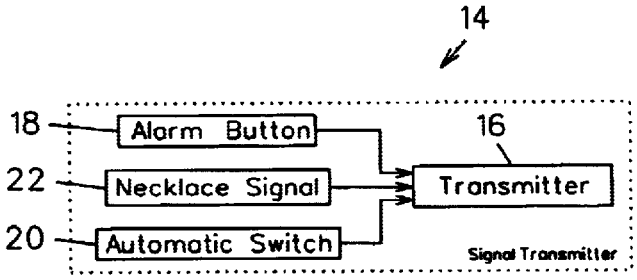
FIG. 3A is a block diagram of the internal components of the transmission unit as in FIG. 1.

The transmission unit 12 includes a transmission housing 14. While the transmission housing 14 shown in FIG. 1 includes a cylindrical configuration, it is understood that other configurations would also be suitable. Preferably, the design and configuration of the transmission housing 14 is ornamental or aesthetically attractive such that it may be worn or carried by a user in a non-conspicuous manner. As shown in FIG. 3A, a transmitter 16 is positioned within the interior space of the transmission housing 14. A first control button 18 is connected to one end of the transmission housing 14 and is electrically connected to the transmitter 16. When depressed by a user, the first control button 18 causes the transmitter 16 to transmit a predetermined alarm signal, such as a radio signal having a predetermined frequency, into the ambient air. A second control button 20 is connected to an opposed end of the transmission housing 14 and is electrically connected to the transmitter 16. When depressed, the second control button 20 causes the transmitter 16 to constantly send range signals into the ambient air until the button is pressed again. These signals correspond with alarm unit modes, as will be described in more detail below. Pressing these buttons in rapid succession or in combination may also provide additional features as to be discussed later.

Opposed ends of a chain or strap 22 are coupled to the transmission housing 14 and electrically connected to the transmitter 16. This attachment may establish a circuit such that removal of either end of the strap 22 (FIG. 6B) is a detectable interruption and which causes the transmitter 16 to transmit the predetermined alarm signal. It is understood that the strap end connections operate like keys and may be disconnected from the transmitter 16 with a predetermined amount of force. Therefore, if a thief attempts to take the transmission unit 12, the strap ends will easily be disconnected and the alarm signal will be transmitted. It should be appreciated that the transmitter 16 may provide the necessary circuitry for transmitting signals as described previously although the transmission unit 12 may also include its own central processor unit having appropriate program instructions. It is also understood that the transmitter 16 may be powered by a battery (not shown).

The alarm unit 30 includes an alarm housing 32 defining an interior space in which electronic components are positioned. As more particularly shown in FIG. 3B, a central processing unit ("CPU") 34 is situated in the alarm housing 32. A receiver 36 is also positioned in the alarm housing 32 and is electrically connected to the CPU 34. An alarm 38 is also positioned in the alarm housing 32 and electrically connected to the CPU 34. The CPU 34, alarm 38, and receiver 36 are preferably electrically connected to a rechargeable battery 33. The alarm 38 may have both audio and visual capabilities and include a speaker 40 and lights 42. Preferably, the speaker 40 extends through a front face of the alarm housing 32 and the lights 42 are a plurality of light emitting diodes (LED's) that are spaced radially about the speaker 40.

Figure 4:
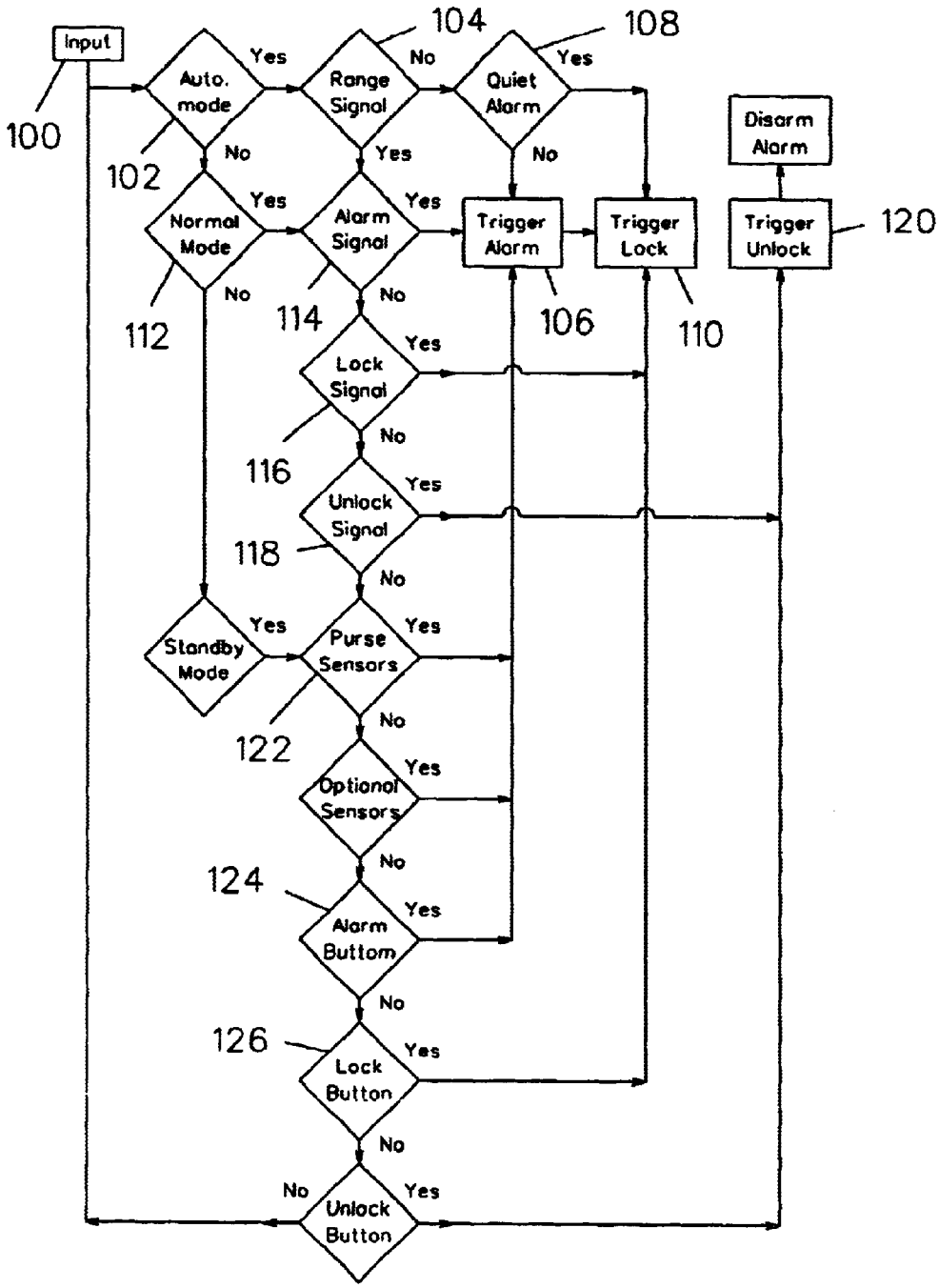
FIG. 4 is a flowchart of the logic performed by the central processing unit of the alarm unit of FIG. 3B.

A mode switch 46 is coupled to the outer surface of the alarm housing 32 and may be moved into various configurations corresponding to multiple nodes of operation. The mode switch 46 is electrically connected to the CPU 34 and initiates the execution of program instructions corresponding to the mode switch setting. One mode configuration is referred to as "automatic mode". In automatic mode, the receiver 36 receives range signals being continuously sent by the transmitter 16 according to actuation of the second control button 20 on the transmission housing 14. It is understood, of course, that the receiver 36 communicates received signals to the CPU 34 for evaluation. If range signals cease to be received while the alarm unit 30 is in automatic mode, then the CPU 34 energizes the alarm 38 (FIG. 4). Another mode configuration is referred to as "alarm mode". In alarm mode, the CPU 34 immediately energizes the alarm 38 when the receiver 36 receives the predetermined alarm signal from the transmitter 16. In addition, an alarm/panic button 50 (also referred to as a third control button) is coupled to the top of the alarm housing 32 and is electrically connected to the CPU 34 such that the CPU 34 immediately energizes the alarm 38 if this button is pressed. It is understood that the alarm unit 30 may be carried in any purse, bag, or the like.

Figure 7:
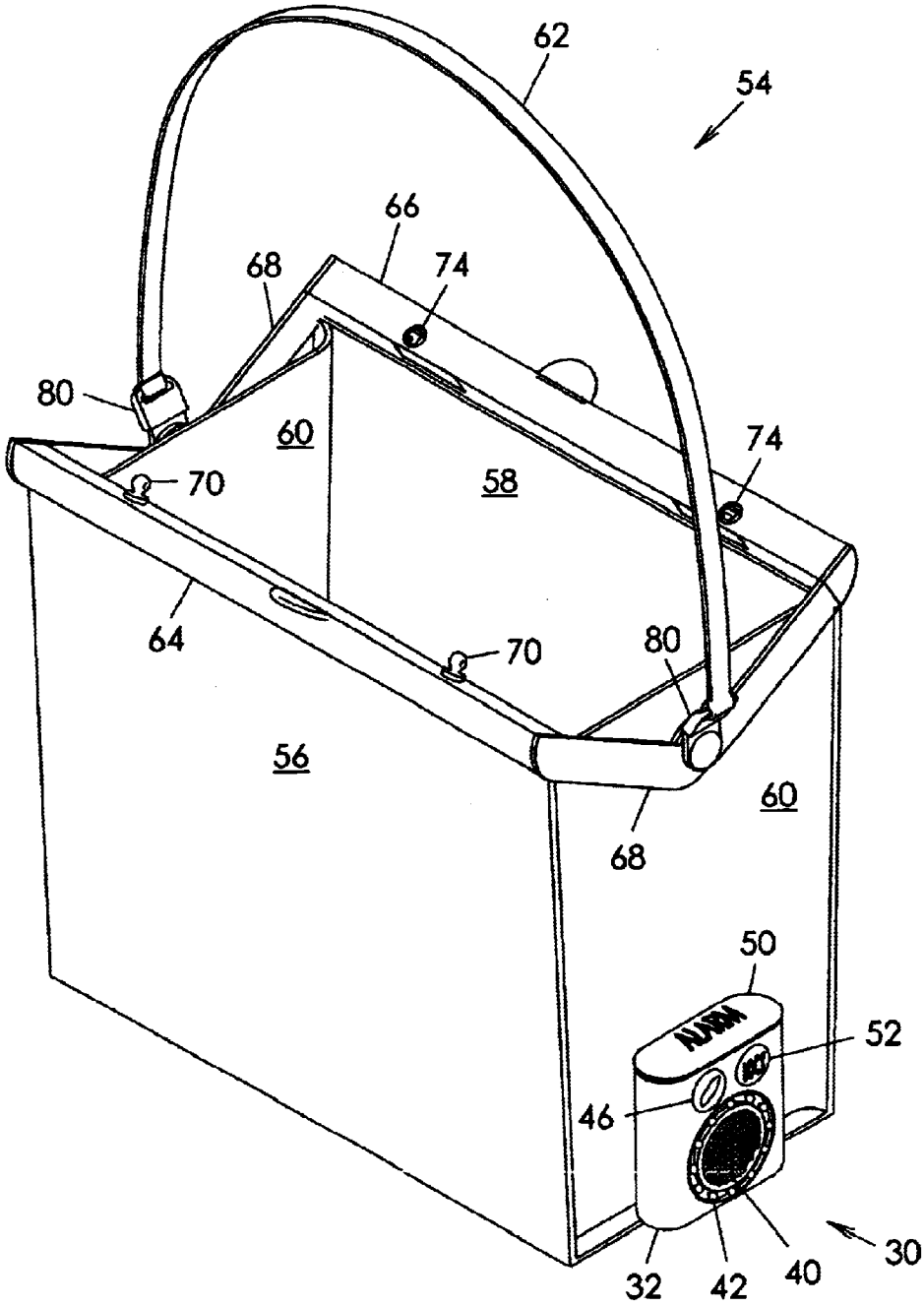
FIG. 7 is a perspective view of the purse as in FIG. 2 in an open configuration.

The personal security alarm system further includes a purse 54 for particular use with the alarm unit 30 (FIG. 7). The basic construction of the purse 54 is conventional and includes a bottom panel with front 56 and back 58 panels extending upwardly therefrom. Flexible side panels 60 extend between the front 56 and back 58 panels. Preferably, a single purse strap 62 extends between the oppose side panels 60. In addition to this basic construction, the purse includes a locking assembly. The locking assembly includes first 64 and second 66 locking braces coupled to respective front 56 and back 58 panels along upper edges thereof. The locking braces 64, 66 are pivotally connected to one another with hinges 68 such that the braces are pivotally movable between an open configuration in which the braces are spaced apart so as to define a purse opening (FIG. 7) and a closed configuration in which the braces bear against one another so as to close the purse opening (FIG. 2).

Figure 8A:
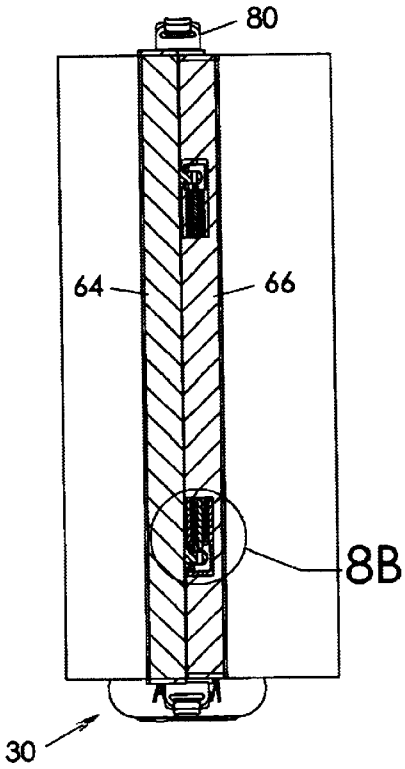
FIG. 8A is a sectional view taken along line 8A—8A of FIG. 2.
Figure 8B:
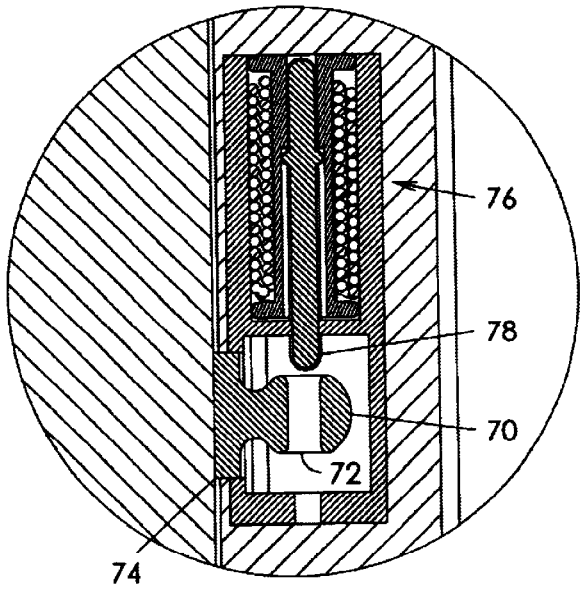
FIG. 8B is an isolated view on an enlarged scale of a locking assembly shown in FIG. 8A.
Figure 9:
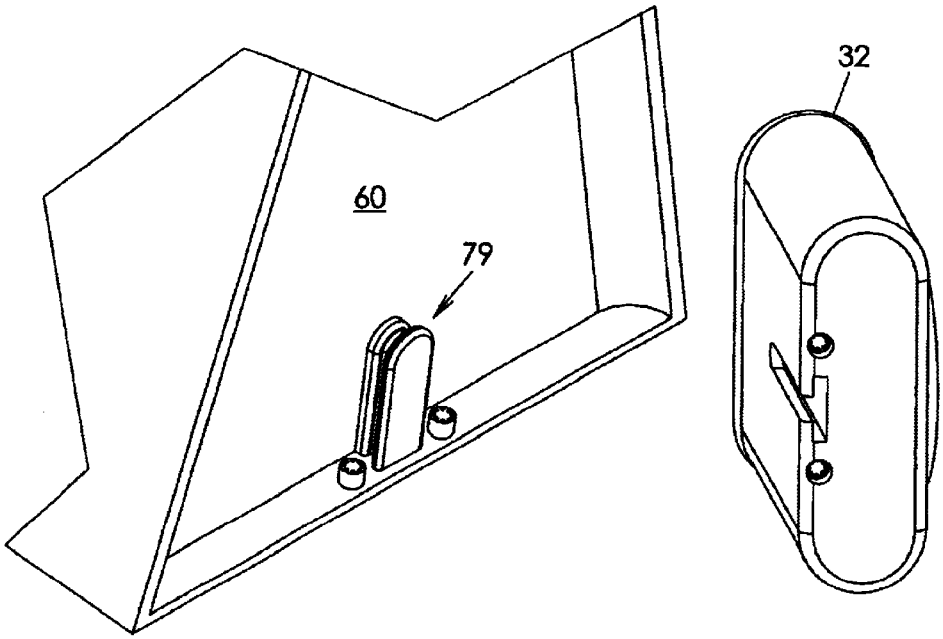
FIG. 9 is an fragmentary exploded view of the purse and alarm unit shown in FIG. 2 with the alarm unit tilted to one side.

The locking assembly further includes electromechanical means for selectively locking the locking braces 64, 66 together or for releasing them. More particularly, at least one snap-type flange 70 extends from the first locking brace 64, the flange 70 defining a through-bore 72 perpendicular to the longitudinal axis of the flange. The second locking brace 66 defines at least one opening 74 having a configuration complementary to a configuration of the at least one flange 70 such that the flange 70 may be releasably received therein in a snap-fit relationship (FIG. 8B). The second locking brace 66 also includes an interior space in which a solenoid 76 is situated. The solenoid 76 includes a pin 78 which, when energized, extends through the through-bore 72 of the flange 70 or is retracted therefrom. Therefore, when the locking braces 64, 66 are in a closed configuration and the solenoid 76 is energized, the purse 54 is locked and bars entry therein by a thief.

A quick-connect attachment assembly 79 is fixedly attached to a side panel 60 of the purse 54, although attachment to some other portion of the purse 54 would also work. The quick-connect attachment assembly and rear surface of the alarm housing 32 include complementary tongue and groove components, respectively, or other similar slidable fastening elements, such that the alarm unit 30 may be releasably coupled to the side panel 60 of the purse 54. A quick-connect prong on the quick-connect assembly and a complementary receptacle in the alarm unit 30 enables the alarm unit 30 to be electrically connected to the solenoid 76.

Figure 5:
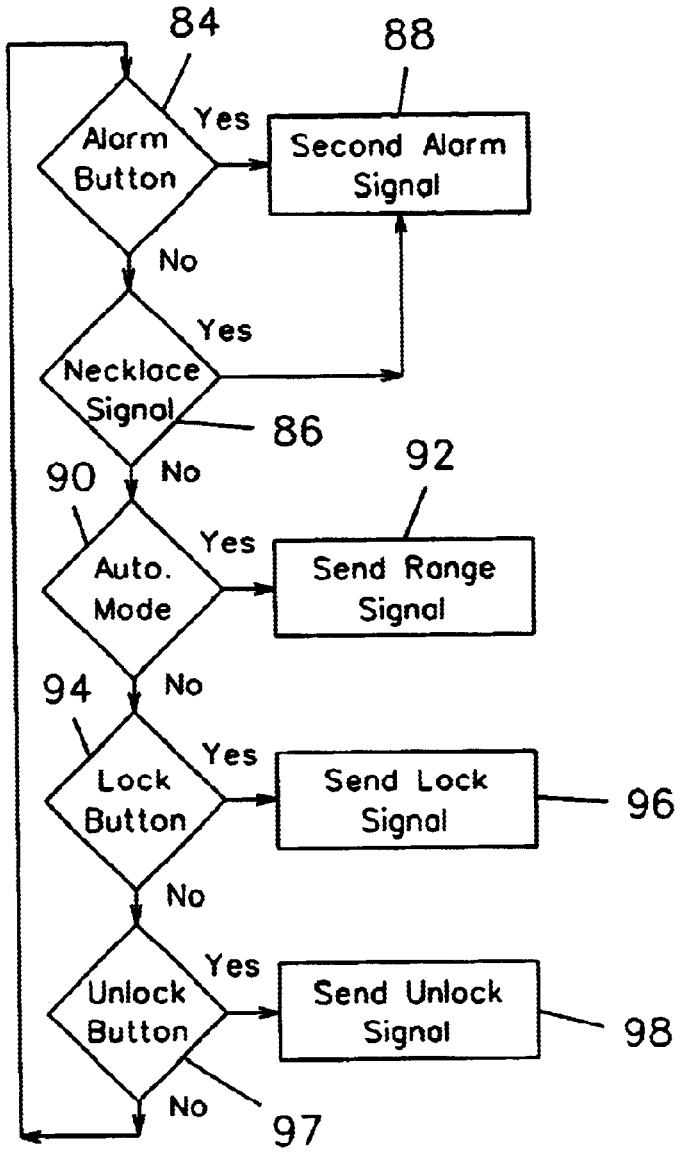
FIG. 5 is a flowchart illustrating the logic performed by the transmission unit of FIG. 3A.
Figure 6A:
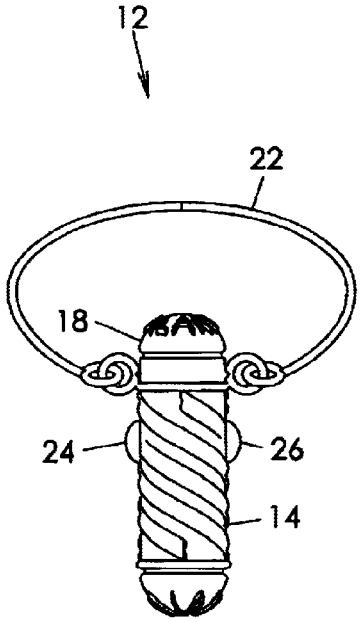
FIG. 6A is a front view of the transmission unit as in FIG. 1 on a reduced scale.
Figure 6B:
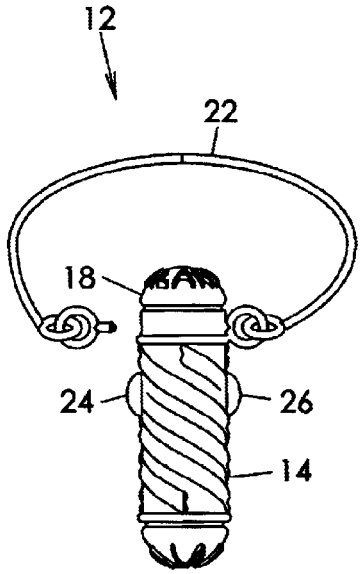
FIG. 6B is a front view of the transmission unit as in FIG. 6A with one end of a transmission housing strap removed from the transmission housing.

A lock button 52 (also referred to as a fourth control button) is situated on the alarm housing 32 and is electrically connected to the CPU 34. When the alarm unit 30 is coupled to the purse 54 and the lock button 52 is depressed, the CPU 34 energizes the solenoid 76 to move the solenoid pin 78 to its extended configuration. If the locking braces 64, 66 are at a closed configuration, then they are locked together by this operation. Another depression of the lock button 52 has an opposite effect. The CPU 34 may also include program instructions for energizing the solenoid 76 as described above in response to multiple alarm signals received from the transmission unit 12. In other words, multiple or rapid user depressions of the first 18 or second 20 control buttons may cause locking or unlocking of the purse 54. Of course, the transmission housing 14 may actually include separate buttons 24, 26 for initiating transmission of appropriate signals to the alarm unit 30 so as to initiate these functions (FIG. 5).

The mode switch 46 may also be placed in a "quiet mode" configuration for initiating another set of CPU instructions.

This mode is substantially similar to the automatic mode for receiving continuous range signals, except that a cessation of range signals does not automatically cause the alarm 38 to be energized. Instead, this event results in the CPU 34 energizing the solenoid to lock the purse 54. This is for the situation in which a user intentionally separates himself from the alarm unit 30, i.e. while paying at a restaurant, but does not want the alarm to go off.

Figure 3B:
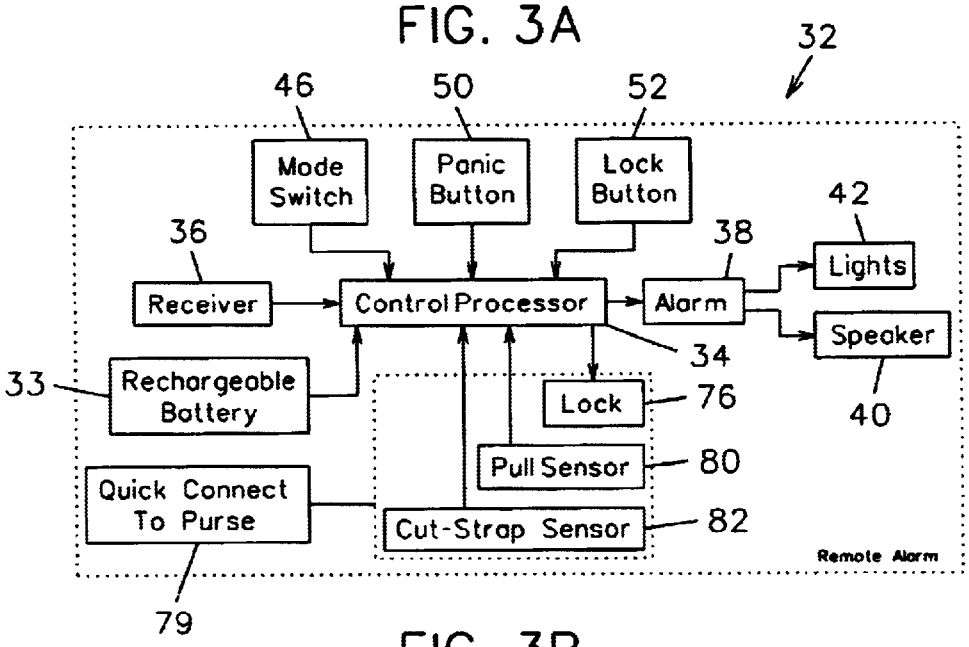
FIG. 3B is a block diagram of the internal components of the alarm unit as in FIG. 2.

Additionally, the purse 54 may include sensors capable of detecting a theft event such that certain actions may be taken automatically and without user action. More particularly, a pull sensor 80 may be coupled to each end of the purse strap 62 (FIG. 7), each pull sensor 80 being electrically connected to the alarm unit CPU 34 (FIG. 3B). Each pull sensor 80 is capable of measuring the tension of the strap 62 and signaling the CPU 34 if a tension greater than a predetermined tension is sensed. Further, a wire sensor 82 may be incorporated into the strap 62. This wire is electrically connected to the CPU 34 (FIG. 3B) and essentially establishes a circuit. If the circuit is broken, such as by a thief cutting the strap 62, the CPU 34 is programmed to energize the alarm 38 or energize the solenoid 76 to lock the purse 54.

Operation of the transmission unit 12 is best understood by making specific reference to FIG. 5. If the alarm button 18 is pressed 84 or the necklace strap 22 is disconnected 86 from the transmission housing 14, the transmitter 16 is energized to send a predetermined alarm signal 88 (FIG. 5). If the automatic mode button 20 is pressed 90, then the transmitter 16 is energized to constantly send range signals 92. If the transmission unit 12 includes lock 24 and unlock 26, buttons, then pressing these buttons 94, 97 energizes the transmitter to send a predetermined lock 96 or unlock signal 98, respectively.

Operation of the alarm unit 30 is best understood by making specific reference to FIG. 4. The CPU 34 receives electrical input 100 from the receiver 36 and from connection to the mode switch 46, control buttons 50, 52 and sensors 80, 82. More particularly, the CPU 34 checks to see if the mode switch 46 is in the automatic mode configuration 102. If so, it checks to see if range signals are being received 104. If not, then the CPU 34 energizes the alarm 38 as indicated at block 106. However, if the mode switch 46 was actually in the quiet mode configuration 108, the alarm is not sounded, but rather the CPU 34 will energize the solenoid 76 to lock the purse 54, as indicated at reference numeral 110.

Further, the CPU 34 checks at 112 and 114 respectively if the mode switch 46 is in the alarm/normal mode configuration and if a predetermined alarm signal is received (FIG. 4). If so, then the CPU 34 is programmed to energize the alarm 38 and solenoid 76, as indicated at blocks 106 and 110, respectively. However, when lock or unlock signals are received 116, 118, the CPU 34 will appropriately energize the solenoid 76 to lock or unlock the purse 54, as indicated at blocks 110 and 120.

Further, if the purse sensors 80, 82 or alarm unit alarm button 50 are pressed as indicated at blocks 122, 124, respectively, then the CPU 34 is programmed to energize the alarm 38, as indicated by reference numeral 106 (FIG. 4). Similarly, if the alarm unit lock button 52 is pressed as indicated by reference numeral 126, the CPU 34 energizes the solenoid 76 to lock the purse 54. Pressing the lock button again (or having a separate unlock button) causes the purse to be unlocked 120.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A personal security alarm system, comprising:

a transmission housing having a transmitter positioned therein;

a first control button situated on said transmission housing and electrically connected to said transmitter for selectively energizing said transmitter to constantly send a range signal;

a second control button situated on said transmission housing and electrically connected to said transmitter for selectively energizing said transmitter to send an alarm signal;

an alarm housing;

a central processing unit (CPU) positioned in said alarm housing;

a receiver positioned in said alarm housing and electrically connected to said CPU;

an alarm positioned in said alarm housing and electrically connected to said CPU;

means in said CPU for energizing said alarm when said range signal is not received by said receiver;

means in said CPU for immediately energizing said alarm when said receiver receives said alarm signal.

2. The alarm system as in claim 1 wherein said alarm housing includes a mode switch movable between automatic and alarm configurations, said mode switch being electrically connected to said CPU for initiating execution of program instructions by said CPU that correspond to a respective mode switch configuration.

3. The alarm system as in claim 1 further comprising:

a chain having opposed ends coupled to said transmission housing such that said transmission housing may be worn as a necklace;

means for energizing said transmitter to send said alarm signal if one of said chain ends is removed from said transmission housing.

4. The alarm system as in claim 1 wherein said alarm includes a speaker and a plurality of light emitting diodes (LEDs) spaced apart radially about said speaker.

5. The alarm system as in claim 1 further comprising:

a third control button situated on said alarm housing and electrically connected to said CPU; and means in said CPU for energizing said alarm when said third control button is depressed.

6. The alarm system as in claim 1, further comprising:

a purse having a bottom panel, opposed front and back panels extending upwardly from said bottom panel with opposed side panels extending between said front and back panels;

a pair of lock braces connected to respective upper edges of said front and back panels, said lock braces being pivotally movable between an open configuration in which said lock braces are spaced apart so as to define a purse opening and a closed configuration in which said lock braces bear against one another so as to close said purse opening;

electromechanical means for selectively locking said pair of lock braces together at said closed configuration;

means for coupling said alarm housing to a respective side panel of said purse; and means for electrically interconnecting said alarm housing with said electromechanical locking means when said alarm housing is coupled to said respective side panel of said purse.

7. The alarm system as in claim 6 further comprising:

a fourth control button situated on said alarm housing and being electrically connected to said CPU; and means in said CPU for energizing said electromechanical locking means when said alarm unit is coupled to said respective side panel of said purse and said fourth control button is depressed.

8. The alarm system as in claim 7 wherein said mode switch is movable to a quiet alarm configuration, said CPU being adapted, when said mode switch is at said quiet alarm configuration and said CPU is electrically interconnected to said electromechanical locking means, to energize said electromechanical locking means and not to energize said alarm if said range signal is not received.

9. The alarm system as in claim 6 further comprising:

a strap having a pair of ends coupled to opposing side panels of said purse; and a pull sensor coupled to at least one of said pair of strap ends and being electrically connected to said CPU when said alarm housing is coupled to said respective side panel of said purse, said pull sensor being adapted to sense a pulling force exerted upon said strap and to send an output signal to said CPU when said sensed pulling force is greater than a predetermined pulling force.

10. A personal security alarm system, comprising:

a transmission housing having a transmitter positioned therein;

a first control button situated on said transmission housing and electrically connected to said transmitter for selectively energizing said transmitter to constantly send a range signal;

a second control button situated on said transmission housing and electrically connected to said transmitter for selectively energizing said transmitter to send an alarm signal;

an alarm housing;

a central processing unit (CPU) positioned in said alarm housing;

a receiver positioned in said alarm housing and electrically connected to said CPU;

an alarm positioned in said alarm housing and electrically connected to said CPU;

a mode switch situated on said alarm housing and movable between automatic and alarm mode configurations, said mode switch being electrically connected to said CPU for initiating program instructions corresponding to respective mode configurations;

means in said CPU for energizing said alarm when said mode switch is at said automatic mode configuration and said range signal is not received by said receiver; and means in said CPU for energizing said alarm when said mode switch is at said alarm mode configuration and said alarm signal is received by said receiver.

11. The alarm system as in claim 10 further comprising a chain having opposed ends coupled to said transmission housing, said opposed ends being electrically connected to said transmitter such that said transmitter is energized to send said alarm signal if at least one of said pair of opposed ends is removed from said transmission housing.

12. The alarm system as in claim 10 wherein said alarm includes a speaker and a plurality of light emitting diodes (LEDs) spaced apart radially about said speaker.

13. The alarm system as in claim 10 further comprising:

a third control button situated on said alarm housing and electrically connected to said CPU; and means in said CPU for energizing said alarm when said third control button is depressed.

14. The alarm system as in claim 10 further comprising:

a purse having a bottom panel and opposed front and back panels extending upwardly from said bottom panel with flexible side panels extending between said front and back panels;

a pair of lock braces positioned longitudinally along respective upper edges of said front and back panels, said front and back panels and respective lock braces being correspondingly movable between an open configuration in which said lock braces are spaced apart so as to define a purse opening and a closed configuration in which said pair of lock braces bear against one another so as to close said purse opening;

a flange extending from one of said pair of lock braces, said flange defining a through-bore perpendicular to a longitudinal axis thereof;

another of said pair of lock braces defining an opening and an interior space in communication with said opening, said opening being complementary to said flange and adapted to releasably receive said flange therein at said closed configuration;

a solenoid positioned in said interior space and having a locking pin selectively movable between extended and retracted configurations, whereby to selectively extend through said through-hole of said flange or be retracted therefrom;

wherein said solenoid is electrically connected to said CPU and said CPU is adapted to selectively energize said solenoid to move said solenoid pin between said retracted and extended configurations.

15. The alarm system as in claim 14 further comprising:

means for coupling said alarm housing to a respective side panel of said purse;

means for electrically connecting said CPU to said solenoid when said alarm housing is coupled to said respective side panel of said purse.

16. The alarm system as in claim 15 further comprising:

a fourth control button situated on said alarm housing and being electrically connected to said CPU; and means in said CPU for energizing said solenoid when said alarm unit is coupled to said respective side panel of said purse and said fourth control button is depressed.

17. The alarm system as in claim 15 wherein said mode switch is movable to a quiet alarm mode configuration, said CPU being adapted, when said mode switch is at said quiet mode configuration and said CPU is electrically connected to said solenoid, to energize said solenoid and not to energize said alarm when said range signal is not received.

18. The alarm system as in claim 14 further comprising:

a strap having a pair of ends coupled to opposing side panels of said purse; and a pull sensor coupled to at least one of said pair of strap ends and being electrically connected to said CPU when said alarm housing is coupled to said respective side panel of said purse, said pull sensor being adapted to sense a pulling force exerted upon said strap and to send an output signal to said CPU when said sensed pulling force is greater than a predetermined pulling force.

19. The alarm system as in claim 14 further comprising:

a strap having a pair of ends coupled to opposing side panels of said purse; and a wire extending longitudinally through said strap and being electrically connected to said CPU and establishing an electrical circuit therewith, said CPU including means for energizing said alarm if said electrical circuit is interrupted.

20. The alarm system as in claim 10 further comprising a rechargeable battery situated in said alarm housing and electrically connected to said CPU, said receiver, and said alarm.

* * * * *